US006109990A

United States Patent [19]

Lundberg

[11] Patent Number: 6,109,990

[45] Date of Patent: Aug. 29, 2000

[54] HYDROTHERAPEUTIC DEVICE FOR THE ANKLE

[76] Inventor: Leslie C. Lundberg, 303 Dublin Cir., Smithville, Mo. 64089

[21] Appl. No.: 09/096,994

[22] Filed: Jun. 13, 1998

[51] Int. Cl.[7] ..... A63B 31/08

[52] U.S. Cl. ..... 441/64; 482/111

[58] Field of Search ..... 441/55, 60, 61, 441/64; 482/55, 111; D21/806, 678, 685

[56] References Cited

U.S. PATENT DOCUMENTS

| | | | |
|---|---|---|---|
| 1,626,541 | 4/1927 | Rosa | 441/61 |
| 3,072,932 | 1/1963 | Ciccotelli . | |
| 3,084,355 | 4/1963 | Ciccotelli | 441/61 |
| 3,913,907 | 10/1975 | Baker | 441/61 |
| 4,944,703 | 7/1990 | Mosier | 441/61 |
| 4,973,049 | 11/1990 | Ciolino . | |
| 5,102,120 | 4/1992 | Lindblad . | |
| 5,183,424 | 2/1993 | Field . | |
| 5,330,377 | 7/1994 | Kernek . | |
| 5,338,275 | 8/1994 | Chek . | |
| 5,417,599 | 5/1995 | Evans . | |
| 5,533,918 | 7/1996 | Sanders . | |

*Primary Examiner*—Stephen Avila

*Attorney, Agent, or Firm*—Hovey, Williams, Timmons & Collins

[57] ABSTRACT

A hydrotherapeutic device for the ankle includes a shoe and a plurality of fins for resisting movement of the foot relative to the ankle. The fins are of substantially equal size and shape and arranged to provide substantially equal resistance to opposite flexion of the foot and opposite turning of the foot when submerged. A set of devices may be provided, with the devices being similar in construction but providing different levels of resistance to foot movement.

25 Claims, 3 Drawing Sheets

HYDROTHERAPEUTIC DEVICE FOR THE ANKLE

BACKGROUND OF THE INVENTION

1. Field of the Invention

The present invention relates generally to medical devices and, more particularly, to a hydrotherapeutic device for the ankle.

2. Discussion of Prior Art

Virtually every ankle injury requires rehabilitation of the soft tissue associated with the ankle. Such rehabilitation is typically necessitated as result of injury to the tissue itself or atrophy of the tissue often caused by prolonged immobilization of the ankle (a common treatment for various ankle injuries). In many situations, it is also desirable to strengthen the soft tissue associated with the ankle so as to reduce the likelihood of injury.

One popular rehabilitation and strengthening method involves movement of the foot relative to the ankle in a body of water. It will be appreciated that the water provides virtually zero-impact resistance to foot movement, thereby safely exercising the tissue involved in moving the foot. Accordingly, hydrotherapy of the ankle traditionally involves flexing the foot upwardly (dorsiflexion) and downwardly (plantarflexion) and turning the foot inwardly (inversion) and outwardly (eversion), so as to rehabilitate and strengthen virtually all the soft tissue associated with the ankle.

It is also known to use devices having fins or paddles for providing increased resistance to foot movement. However, conventional hydrotherapeutic devices fail to effectively rehabilitate and strengthen the ankle. It is believed that conventional devices will often create muscle imbalance, which actually increase the likelihood of injury to the ankle. In particular, conventional devices do not provide equal resistance to foot movement when the foot flexes or turns in opposite directions. Another problem with conventional hydrotherapeutic devices is their inability to provide treatment during the various stages of rehabilitation or strengthening. That is to say, it may be desirable to increase the resistance to foot movement as the ankle becomes stronger, although conventional devices are not effective in providing such graded treatment.

OBJECTS AND SUMMARY OF THE INVENTION

Responsive to these and other problems, an important object of the present invention is to provide a device that is particularly effective in rehabilitating and strengthening for the ankle. Another object of the present invention is to provide a device that reduces the likelihood of muscle imbalance during hydrotherapy of the ankle. In this respect, it is also an object of the present invention to provide a hydrotherapeutic device for the ankle that equally resists opposite turning of the foot (i.e., inversion v. eversion) and opposite flexion of the foot (i.e., plantarflexion v. dorsiflexion). Yet another object of the present invention is to provide a set of hydrotherapeutic devices that offer different levels of resistance to foot movement so as to provide treatment at various stages of rehabilitation and strengthening.

In accordance with these and other objects evident from the following description of the preferred embodiment, the present invention concerns a hydrotherapeutic device for the ankle comprising a shoe and a plurality of fins coupled to the shoe. The fins are of substantially equal size and shape and arranged to provide substantially equal resistance to opposite flexion and opposite turning of the foot when submerged. The preferred fins are spaced equally about and project radially from a common axis extending in a generally fore-and-aft direction when the shoe is attached to the foot. In addition, the fins may be equal in number so that each of the fins is generally coplanar with a corresponding one of the fins and projects in a generally opposite direction from the common axis than the corresponding one of the fins. It is also desirable to provide a set of devices that are generally similar in construction, but which provide different levels of resistance to foot movement.

Other aspects and advantages of the present invention will be apparent from the following detailed description of the preferred embodiment and the accompanying drawing figures.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

Figure 1:
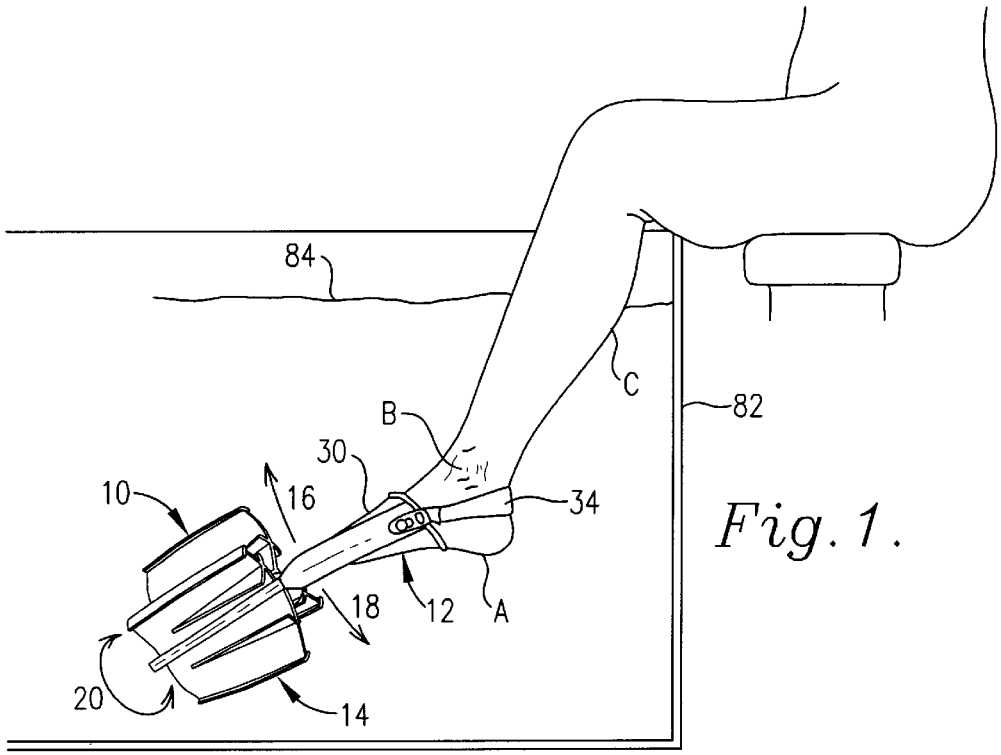
FIG. 1 is a slightly perspective view of a hydrotherapeutic device constructed in accordance with the principles of the present invention, particularly illustrating the device secured to the left foot of a wearer and submerged within a tank of water for treating the ankle.

Turning initially to FIG. 1, the hydrotherapeutic device 10 selected for illustration generally includes a shoe 12 and a fin assembly 14 projecting forwardly from the shoe 12. The fin assembly 14 is designed to evenly resist opposite flexion (represented by the arrows 16 and 18 in FIG. 1) and opposite turning (represented by the arrow 20 in FIG. 1) of the foot A when submerged. In this respect, the device 10 may be used in rehabilitating and strengthening the soft tissue associated with the ankle B, without creating muscle imbalance, as will subsequently be described.

Figure 4:
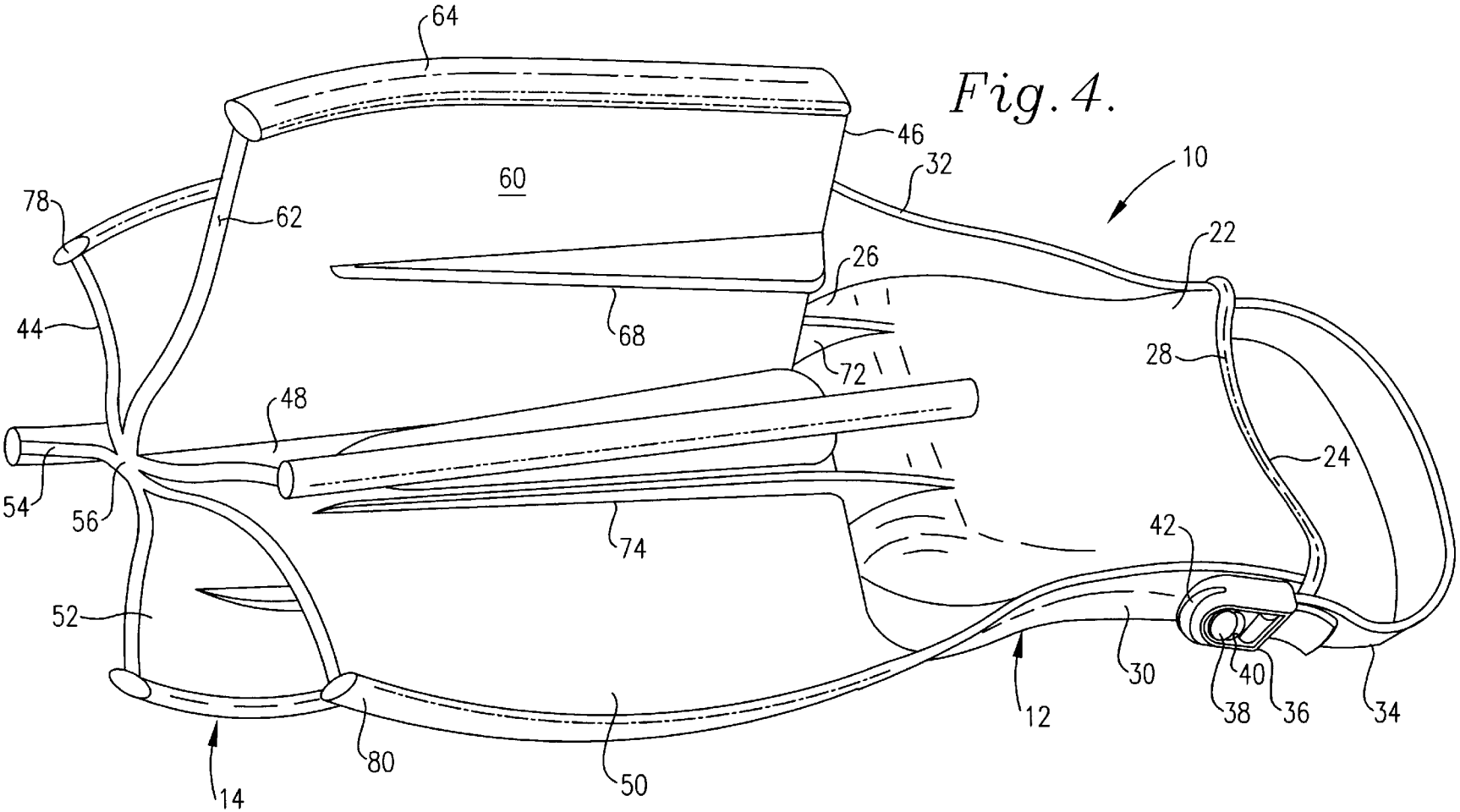
FIG. 4 is an enlarged, perspective view of the hydrotherapeutic device.

As perhaps best shown in FIG. 4, the shoe 12 includes a hollow casing 22 designed to snugly receive the portion of the foot A extending from the toes to the midtarsal region. The casing 22 has an open rear end 24 and a closed forward end 26, although both ends may be open if desired. A rib 28 extends around the open rear end 24 of the casing 22 to reinforce this portion of the casing 22 and enhance the comfort of the shoe 12 when worn. A pair of panels 30 and 32 extend partly along the sides of the casing 22, with the forwardmost ends of the panels 30,32 being tapered (see FIG. 1) and spaced from the forward end 26 of the casing 22.

As will subsequently be described, the panels 30 and 32 are interconnected with a portion of the assembly 14.

Figure 3:
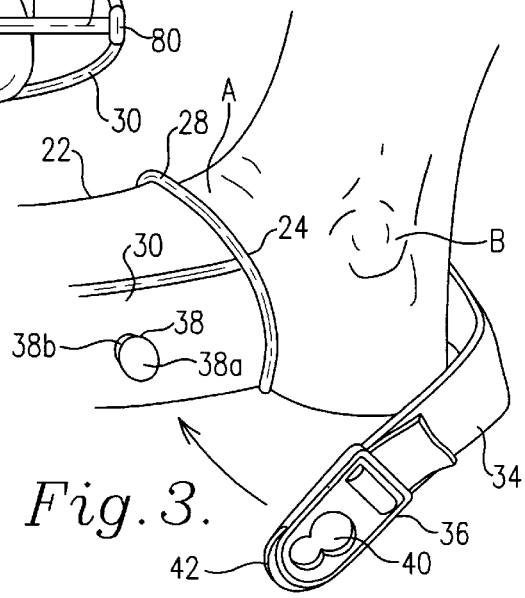
FIG. 3 is a fragmentary, enlarged, perspective view of the rear portion of the device, particularly illustrating the manner in which the shoe is secured to the foot of the wearer.

The shoe 12 further includes a heel strap 34 having its ends adjustably connected to the casing 22 for tightly securing the casing 22 on the foot A. Particularly, a connector 36 (only one of the connectors being shown in the drawing figures) is provided adjacent each end of the strap 34 for releasable connection with a mushroom-shaped projection 38 extending laterally from the respective panel 30 or 32 (see also FIG. 3). The connector 36 has an opening 40 in the shape of a pair of intersecting circles of different sizes, whereby the bulbous portion 38*a* of the projection 38 is first received through the relatively larger portion of the opening. Once the bulbous portion 38*a* has passed through the opening 40 so that the connector 36 is against the panel 30, the connector 36 is shifted rearwardly so that the stem portion 38*b* is retained within the smaller portion of the opening 40, and the connector 36 consequently cannot disengage the projection 38 without being slid forwardly. The connector 36 includes a tab 42 for facilitating grasping of the connector 36.

Thus, the shoe 12 is donned simply by inserting the foot A through the open rear end 24 of the casing 22. The heel strap 34 is then placed about the heel of the foot A and attached to the casing 22 by coupling each connector 36 to the corresponding projection 38. With the heel strap 34 looped through the connector 36, the strap 34 may be tightened simply by pulling its ends so as to securely attach the shoe 12 on the foot A. If desired, the shoe 12 may be provided with only one of the connectors 36, such that the opposite end of the strap 34 is not adjustably connected to the casing 22.

The primary function of the shoe 12 is to secure the assembly 14 to the foot A. Accordingly, the construction of the shoe 12 may be varied, if desired, as long as the alternative shoe design securely anchors the assembly 14 to the foot A. For example, the shoe may include a closed heel portion (not shown) rather than the illustrated adjustable strap 34. Another example of a suitable alternative design comprises a sole plate (not shown) and at least one strap (also not shown) projecting from the plate to tightly wrap around the foot for retaining the plate against the bottom of the foot.

Figure 2:
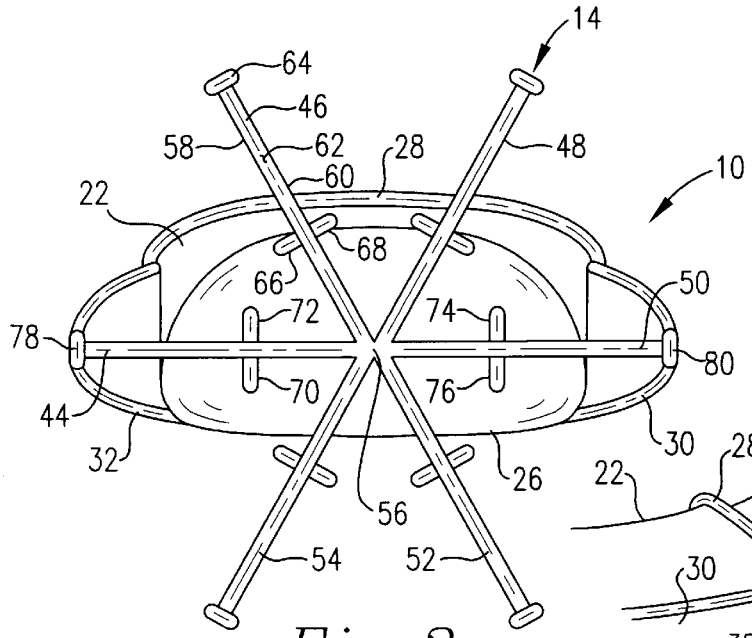
FIG. 2 is an enlarged, somewhat schematic, front end elevational view of the hydrotherapeutic device, particularly illustrating the arrangement of the fins about a common central axis.

The fin assembly 14 includes a plurality of fins 44,46,48,50,52,54 arranged and configured to equally resist opposite flexion and opposite turning of the foot A. Particularly, the fins 44,46,48,50,52,54 are similarly dimensioned and consequently have generally the same size and shape. As perhaps best shown in FIG. 2, the fins 44,46,48,50,52,54 project radially from a common central location 56 defining a fore-and-aft axis when the shoe 12 is placed on the foot. In addition, the fins 44,46,48,50,52,54 are spaced equally about the central location 56. Because the illustrated assembly 14 includes an even number of fins, each of the fins is coplanar with a corresponding one of the fins and projects in an opposite direction from the central location 56 than the corresponding fin (e.g., see fins 44 and 50). Further, because of the equal spacing and the fact that the illustrated assembly 14 includes six fins, the fins 44,46,48,50,52,54 are spaced approximately sixty degrees from one another. It will also be noted that the central location 56 is spaced substantially equally from the top and bottom margins of the forward end 26 of the casing 22, with the fins 44 and 50 projecting laterally toward the sides of the casing 22.

Because the fins 44,46,48,50,52,54 have substantially equal size and shape, only one of the fins will be described in detail herein, with the understanding that the remaining fins are similarly constructed. The fin 46 is generally defined by a pair of flat, coplanar, spaced apart faces 58 and 60 that are generally rectangular in shape, except for the forwardmost edge 62 that curves outwardly toward the central location 56. The fin 46 includes an elliptical-shaped, enlarged section 64 extending along its outermost edge for stiffening the fin 46. A pair of aligned, forwardly tapering reinforcing ribs 66 and 68 project outwardly from the opposite faces 58 and 60 at a location spaced substantially equally from the enlarged section 64 and central location 56. Although the remaining fins 44,48,50,52,54 are similarly constructed, it will particularly be noted that the reinforcing ribs 70,72 and 74,76 of the fins 44 and 50, respectively, project rearwardly and connect to the casing 22 (see FIG. 4). In addition, the outermost enlarged sections 78 and 80 of the fins 44 and 50 similarly connect to the forwardmost ends of the panels 30 and 32, respectively. This arrangement serves to interconnect the shoe 12 and the fin assembly 14. In fact, it is preferred that the shoe 12 (except for the strap 30 and connectors 36) and fin assembly 14 be integrally formed of a rubber material.

The hydrotherapeutic device 10 is used to rehabilitate and strengthen the ankle B by first securing the shoe 12 on the foot A, as noted above. As shown in FIG. 1, the wearer is typically positioned adjacent a tank 82 filled with a body of water 84 so that the device 10 may be submerged. In most cases, a portion of the leg C is submerged, along with the foot A and ankle B. As a result of the construction of the fin assembly 14, opposite flexion and turning of the foot A is equally resisted. Particularly, movement of the foot A in the direction of arrow 16 (i.e., dorsiflexion) is resisted primarily by the fins 44 and 50 and to some degree by the fins 46 and 48, and even to a lesser degree by the fins 52 and 54. In a similar manner, the fins 44,46,48,50,52,54 equally resist oppositely directed movement of the foot A in the direction of arrow 18 (i.e., plantarflexion). Again, this is attributable to the unity in fin design and the arrangement of the fins. With respect to opposite turning of the foot (i.e., inversion and eversion of the foot represented by the arrow 20), the fins 44,46,48,50,52,54 provide generally the same degree of resistance to such movement, such that the fin assembly 14 provides equal resistance to inversion and eversion of the foot A.

Figure 5:
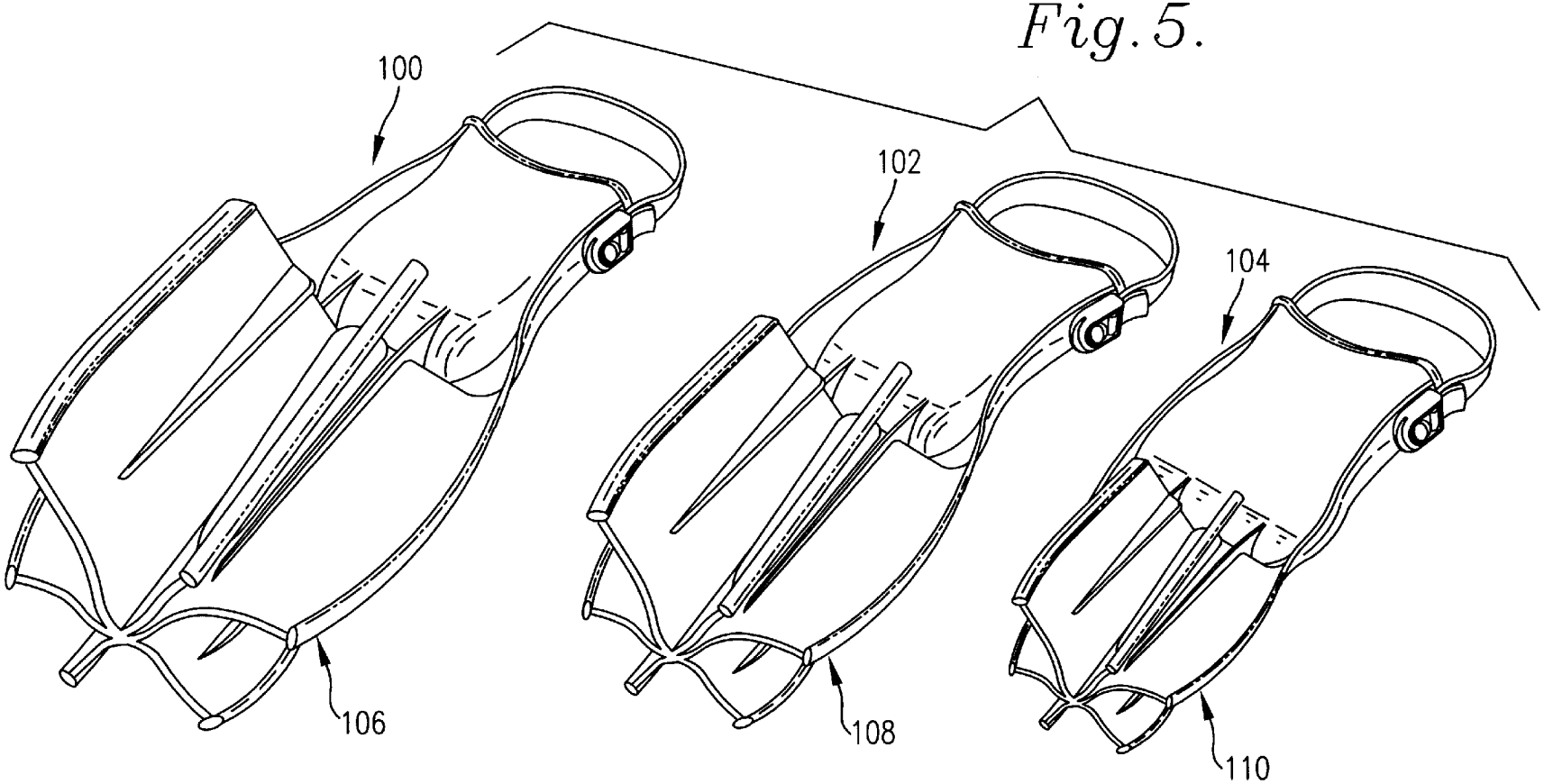
FIG. 5 is a perspective view of a set of hydrotherapeutic devices, with each of the devices being similar in construction to the device shown in FIGS. 1–4, but offering various degrees of resistance to foot movement.

The present invention also contemplates a set of hydrotherapeutic devices 100,102,104 (see FIG. 5) for providing various levels of resistance to foot movement, although each device is designed to provide equal resistance to opposite turning and opposite flexion of the foot similar to the device 10 shown in FIGS. 1–4. Therefore, the set of devices is useful during all stages of rehabilitation and strengthening of the ankle.

Particularly, each of the devices 100,102,104 has generally the same construction as the device 10 shown in FIGS. 1–4, however, the fin assemblies 106,108,110 of the devices vary in size so as to provide the various levels of resistance. Preferably, the fin assembly 106 of the largest device 100 includes fins with opposite faces each having a surface area that is approximately one and two-thirds larger than the similarly defined surface area on the fin assembly 108 of the intermediate device 102. On the other hand, the surface area of the fin faces of the fin assembly 108 is approximately two times larger than the similar surface area on the fin assembly 110 of the smallest device 104. Because resistance (i.e., drag) is directly proportional to the projected area of a body on a plane normal to the direction of movement, the largest device 100 offers approximately one and two-thirds greater resistance to foot movement than the intermediate device 102, while the intermediate device 102 offers approximately two times as much resistance to foot movement than the smallest device 104.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A hydrotherapeutic device for the ankle, said device comprising:

a shoe attachable to the foot; and a plurality of fins coupled to the shoe and projecting from a common axis, all of said fins being of substantially equal size and shape so as to provide substantially equal resistance to opposite flexion and opposite turning of the foot when the shoe is attached to the foot and the fins are submerged.

2. A device as claimed in claim 1, said fins being spaced equally about the common axis and projecting radially therefrom, said common axis extending in a generally fore-and-aft direction when the shoe is attached to the foot.

3. A device as claimed in claim 1, said shoe including a casing defining an opening for receiving the foot at least from the toes to the midtarsal region of the foot, said plurality of fins projecting forwardly from the casing when the foot is received within the opening.

4. A device as claimed in claim 3, said shoe including a heel strap adjustably connected to the casing for permitting selective tightening about the heel.

5. A hydrotherapeutic device for the ankle, said device comprising:

a shoe attachable to the foot; and a plurality of fins of substantially equal size and shape coupled to the shoe and arranged to provide substantially equal resistance to opposite flexion and opposite turning of the foot when the shoe is attached to the foot and the fins are submerged, said fins being spaced equally about and projecting radially from a common axis extending in a generally fore-and-aft direction when the shoe is attached to the foot, said fins being even in number, such that each of the fins is generally coplanar with another one of the fins and projects in a generally opposite direction from the common axis than said another one of the fins.

6. A device as claimed in claim 5, each of said fins presenting opposite, substantially flat faces, each of said fins including a reinforcing rib projecting outwardly from at least one of the faces.

7. A device for providing multidirectional resistance to foot movement in water, said device comprising:

a shoe attachable to the foot; and a plurality of angularly spaced fins coupled to the shoe and projecting radially from a common axis extending in a generally fore-and-aft direction when the shoe is attached to the foot, all of said fins being of substantially equal size and shape.

8. A device as claimed in claim 7, said fins being spaced equally from one another about the common axis.

9. A device as claimed in claim 7, said shoe including a casing defining an opening for receiving the foot at least from the toes to the midtarsal region of the foot.

10. A device as claimed in claim 9, said plurality of fins projecting forwardly from the casing when the foot is received within the opening.

11. A device as claimed in claim 9, said shoe including a heel strap adjustably connected to the casing for permitting selective tightening about the heel.

12. A device as claimed in claim 7, said shoe and said fins being formed of a rubber material.

13. A device for providing multidirectional resistance to foot movement in water said device comprising:

a shoe attachable to the foot; and a plurality of angularly spaced fins coupled to the shoe and projecting radially from a common axis extending in a generally fore-and-aft direction when the shoe is attached to the foot, said fins being spaced equally from one another about the common axis, said fins being even in number, such that each of the fins is generally coplanar with another one of the fins and projects in a generally opposite direction from the common axis than said another one of the fins.

14. A device as claimed in claim 13, said fins being spaced approximately 60 degrees from one another about the common axis, whereby the device includes six fins.

15. A device as claimed in claim 13, said fins being of substantially equal size and shape.

16. A device for providing multidirectional resistance to foot movement in water, said device comprising:

a shoe attachable to the foot; and a plurality of angularly spaced fins coupled to the shoe and projecting radially from a common axis extending in a generally fore-and-aft direction when the shoe is attached to the foot, each of said fins presenting opposite, substantially flat faces each of said fins including a reinforcing rib projecting outwardly from at least one of the faces.

17. A set of hydrotherapeutic devices for the ankle, wherein each device is selected because of the amount of multidirectional resistance to foot movement provided thereby, said set comprising:

a first device including— a first shoe attachable to the foot, and a plurality of first fins of substantially equal size and shape coupled to the first shoe and arranged to provide substantially equal resistance to opposite flexion and opposite turning of the foot when the first shoe is attached to the foot and the fins are submerged; and at least one additional device including— a second shoe attachable to the foot, and a plurality of second fins of substantially equal size and shape coupled to the second shoe and arranged to provide substantially equal resistance to opposite flexion and opposite turning of the foot when the second shoe is attached to the foot and the fins are submerged, said second fins being configured to provide relatively greater resistance to foot movement than said first fins.

18. A set of devices as claimed in claim 17, said first and second shoes being substantially similar.

19. A set of devices as claimed in claim 17, said second fins providing approximately two times as much resistance to foot movement than said first fins.

20. A set of hydrotherapeutic devices for the ankle, wherein each device is selected because of the amount of multidirectional resistance to foot movement provided thereby, said set comprising:

a first device including— a first shoe attachable to the foot, and a plurality of first fins of substantially equal size and shape coupled to the first shoe and arranged to provide substantially equal resistance to opposite flexion and opposite turning of the foot when the first shoe is attached to the foot and the fins are submerged; and at least one additional device including— a second shoe attachable to the foot, and a plurality of second fins of substantially equal size and shape coupled to the second shoe and arranged to provide substantially equal resistance to opposite flexion and opposite turning of the foot when the second shoe is attached to the foot and the fins are submerged, said second fins being configured to provide relatively greater resistance to foot movement than said first fins, said first fins and said second fins being substantially similar in shape, such that said second fins are relatively larger than said first fins.

21. A hydrotherapeutic device for the ankle, said device comprising:

a shoe attachable to the foot; and a fin assembly comprising a plurality of fins coupled to the shoe and configured to resist foot movement in all directions about the ankle, said fin assembly providing at least substantially uniform resistance to foot movement when the foot moves in any direction about the ankle.

22. A hydrotherapeutic device as claimed in claim 21, said fins cooperatively presenting a surface area that generally faces the direction of foot movement, said surface area being at least substantially constant irrespective of the direction of foot movement.

23. A hydrotherapeutic device for the ankle, said device comprising:

a shoe attachable to the foot; and a plurality of fins coupled to the shoe and configured to resist foot movement in all directions about the ankle, said fins cooperating to provide at least substantially uniform resistance to foot movement irrespective of the direction the foot moves about the ankle, said fins cooperatively presenting a surface area that generally faces the direction of foot movement, said surface area being at least substantially constant irrespective of the direction of foot movement, said fins projecting from a common axis and being of substantially equal size and shape.

24. A hydrotherapeutic device as claimed in claim 23, said common axis extending in a fore-and-aft direction when the shoe is attached to the foot, said fins being spaced equally about the common axis and projecting radially therefrom.

25. A hydrotherapeutic device as claimed in claim 24, said fins being even in number, such that each of the fins is generally coplanar with another one of the fins and projects in a generally opposite direction from the common axis than said another one of the fins.

* * * * *